US005901386A

United States Patent [19]

Bragalone

[11] Patent Number: 5,901,386

[45] Date of Patent: May 11, 1999

[54] SIGNAGE PLATFORM FOR A SWIMMING POOL

[76] Inventor: Jon A. Bragalone, 10633 Sheffield Cove, Fort Wayne, Ind. 46804

[21] Appl. No.: 08/980,881

[22] Filed: Nov. 25, 1997

Related U.S. Application Data

[63] Continuation-in-part of application No. 29/059,040, Aug. 30, 1996, Pat. No. Des. 391,299.

[51] Int. Cl.[6] ..... E04H 04/14

[52] U.S. Cl. ..... 4/496; 4/506; 40/299.01; 40/606; 40/611; 40/631; 52/102; 52/105

[58] Field of Search ..... 4/496, 504, 506, 4/488; D20/19; 40/299.01, 630, 631, 606, 611; 52/102, 105, 38, 169.7

[56] References Cited

U.S. PATENT DOCUMENTS

| | | | |
|---|---|---|---|
| 2,498,956 | 2/1950 | Johnson | 40/606 |
| 4,603,521 | 8/1986 | Engelhart | 4/506 X |
| 5,107,551 | 4/1992 | Weir et al. | 4/496 |
| 5,134,819 | 8/1992 | Boyack | 52/102 X |
| 5,678,254 | 10/1997 | Jardim | 4/504 |
| 5,680,730 | 10/1997 | Epple | 4/496 X |
| 5,729,934 | 3/1998 | Ochoa | 52/105 |

*Primary Examiner*—Henry J. Recla
*Assistant Examiner*—Kathleen J. Prunner
*Attorney, Agent, or Firm*—Taylor & Associates, P.C.

[57] ABSTRACT

A swimming pool has a plurality of substantially vertical side walls, with each side wall having a top. A coping is attached to the top of a side wall of the pool and has a curved facia. A signage platform is attached to the facia of the coping. The signage platform has a substantially vertical display wall and an adjoining substantially horizontal display wall. Visual indicia are located on each of the vertical display wall and the horizontal display wall.

8 Claims, 2 Drawing Sheets

SIGNAGE PLATFORM FOR A SWIMMING POOL

CROSS REFERENCE TO RELATED APPLICATIONS

This is a continuation-in-part of U.S. patent application Ser. No. 29/059,040, entitled "SIGNAGE PLATFORM ATTACHED TO A SWIMMING POOL COPING", filed Aug. 30, 1996, and now U.S. Pat. No. D.391,299.

BACKGROUND OF THE INVENTION

1. Field of the Invention

The present invention relates to swimming pools, and, more particularly, to coping assemblies for use with swimming pools.

2. Description of the Related Art

Swimming pools are typically constructed with concrete side walls or a vinyl pool liner suspended from the top, periphery of the pool which defines the side walls. Regardless of the type of construction employed, swimming pools commonly include a shallow end and a deep end. Unfortunately, and despite precautions by the manufacturer, a swimmer may occasionally and foolishly dive into the shallow end of a swimming pool. It is known to place a warning sticker directly onto the coping of a swimming pool to warn a swimmer not to dive into a shallow swimming pool. If the letters on the warning sticker are nearly as tall as the sticker itself, then the lettering can only be read in a normal manner from one orientation. That is, a warning sticker placed on top of the coping with the lettering extending from left to right when viewed from the top may not be easily read when observed from the opposite side of the swimming pool.

What is needed in the art is a warning sign which may be easily attached to the swimming pool and observed from a swimmer on either side of the swimming pool.

SUMMARY OF THE INVENTION

The present invention provides a signage platform which is attached to a coping of a swimming pool with two display walls which are respectively observable by a swimmer from two sides of the swimming pool.

The invention comprises, in one form thereof, a swimming pool having a plurality of substantially vertical side walls, with each side wall having a top. A coping is attached to the top of a side wall of the pool and has a curved facia. A signage platform is attached to the facia of the coping. The signage platform has a substantially vertical display wall and an adjoining substantially horizontal display wall. Visual indicia are located on each of the vertical display wall and the horizontal display wall.

An advantage of the present invention is that the signage platform may be observed and easily understood by a swimmer located either on the same side of the pool which the signage platform is located, or the opposite side of the pool from which the signage platform is located.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
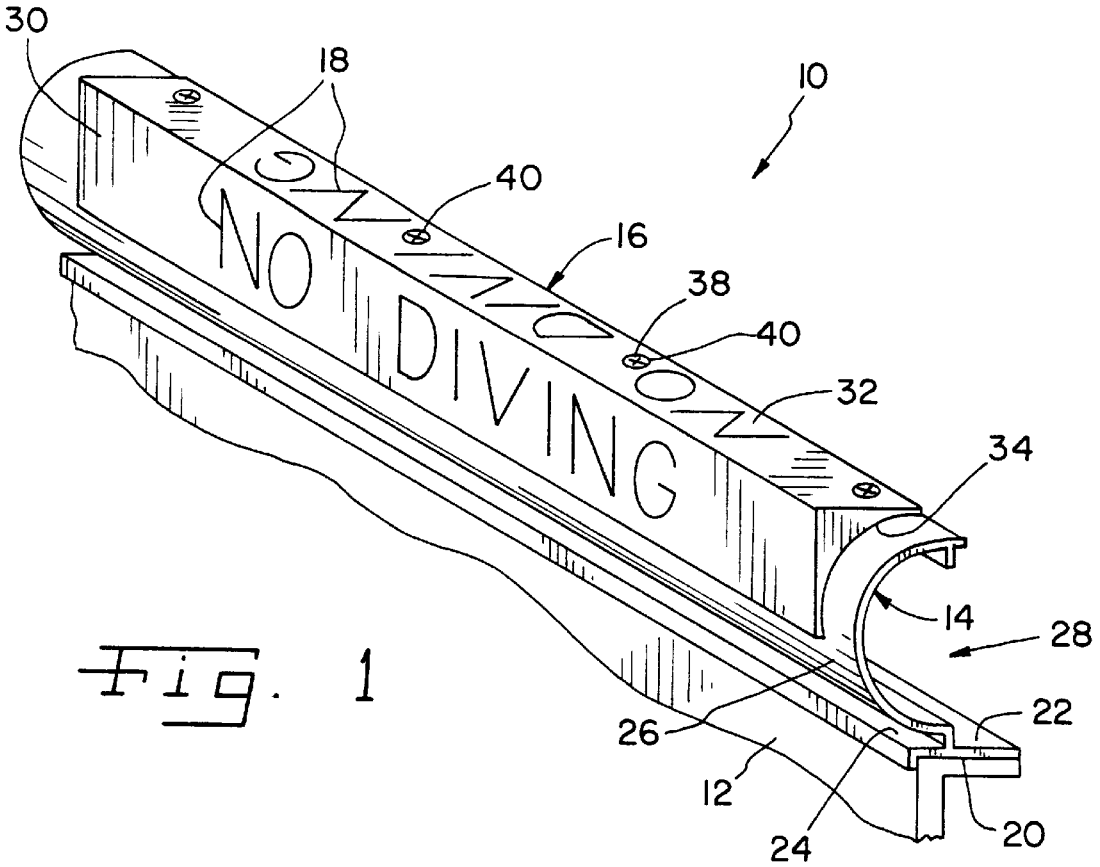
FIG. 1 is a partial, perspective view of a portion of a swimming pool of the present invention including a signage platform attached to a coping.
Figure 2:
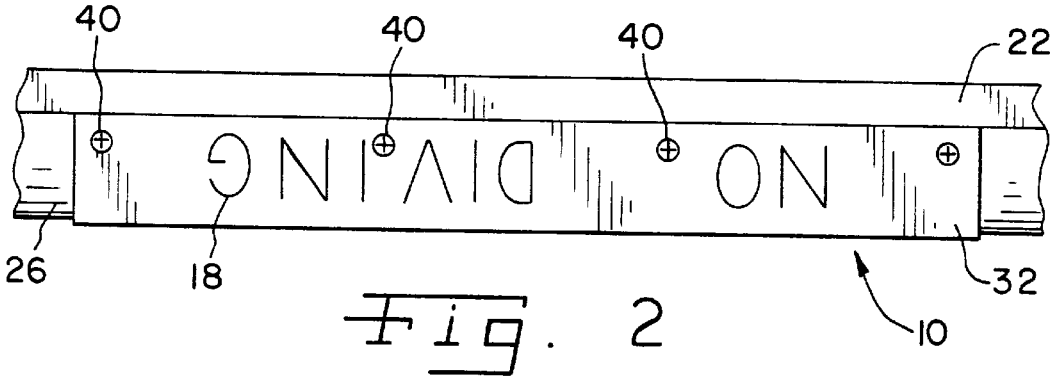
FIG. 2 is a top view of the swimming pool of FIG. 1.
Figure 3:
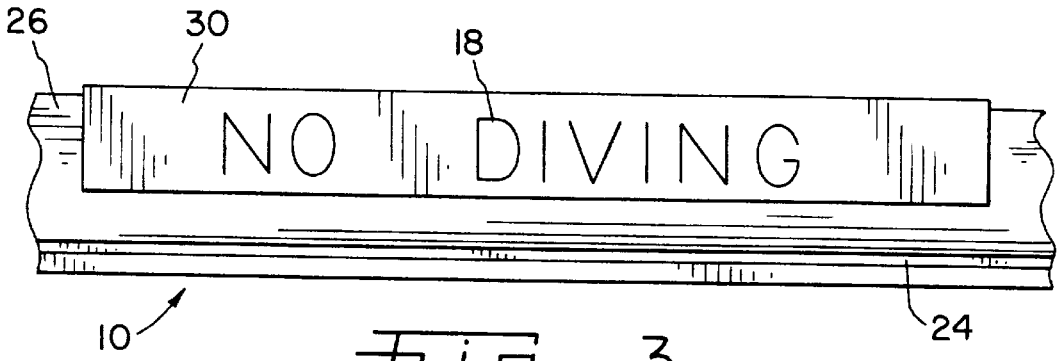
FIG. 3 is a side view of the swimming pool of FIG. 1.
Figure 4:
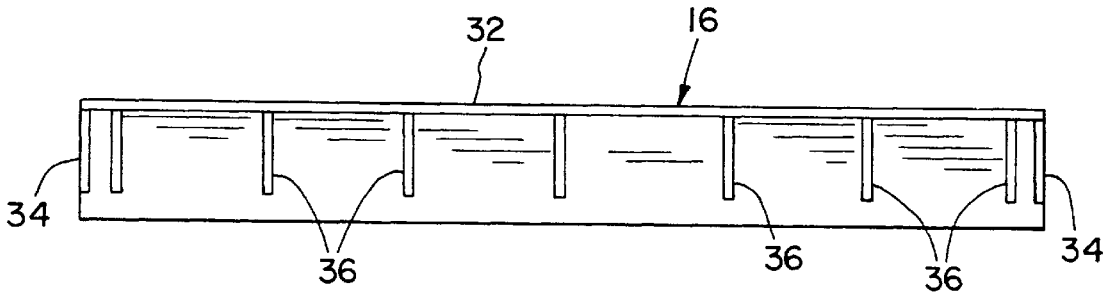
FIG. 4 is a rear view of the signage platform shown in FIGS. 1–3.
Figure 5:
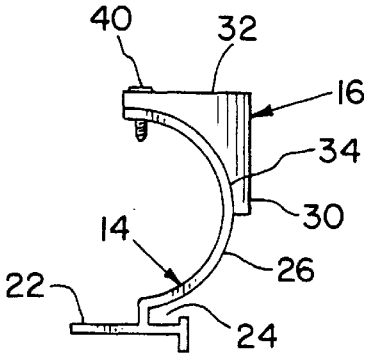
FIG. 5 is an end view of the signage platform and coping shown in FIGS. 1–3.

Referring now to the drawings, and more particularly to FIG. 1, there is shown a perspective view of a portion of an embodiment of a swimming pool 10 of the present invention, including a side wall 12, coping 14, and a signage platform 16 with visual indicia 18 thereon.

Side wall 12 is one of a plurality of substantially vertical side walls enclosing swimming pool 10 in a known manner. Each side wall 12 includes a top 20 which may include a flange, as shown, or be otherwise configured.

Coping 14 is attached to top 20 of side wall 12, and may be of known construction. Coping 14 includes a bottom portion 22 which interconnects with top 20 of side wall 12. Coping 14 also includes a liner bead slot 24 for receiving a liner bead of a pool liner (not shown) therein. A facia 26 having a convex curvature extends from liner bead slot 24 to a top (not numbered) of coping 14. Facia 26 may have virtually any curved shape, but is typically in the form of a convex curve. The opposite side of facia 26 defines a recess 28 in which a suitable walkway material such as concrete is received for surrounding swimming pool 10.

Signage platform 16 is attached to facia 26 of coping 14, and includes a substantially vertical display wall 30 and an adjoining substantially horizontal display wall 32. Vertical display wall 30 and horizontal display wall 32 provide display surfaces for receiving visual indicia 18 thereon. By providing two display walls rather than one, and by respectively orienting the display walls at a vertical orientation and at a horizontal orientation, the visual indicia 18 may be observed by a swimmer on either side of the swimming pool. For a swimmer standing on the same side of the swimming pool as which the signage platform 16 is located, visual indicia 18 may be observed on horizontal display wall 32. Likewise, a swimmer standing on the opposite side of swimming pool 10 from which signage platform 16 is located may observe visual indicia 18 on vertical display wall 30. Visual indicia 18 are thus positioned on vertical display wall 30 and horizontal display wall 32 corresponding to their respective locations from which a swimmer is intended to read the same. That is, when in the form of lettering, visual indicia 18 is positioned to read from left to right when viewed from the top of horizontal display wall 32 or from the side of vertical display wall 30.

Signage platform 16 may be attached to facia 26 of coping 14 in any suitable manner. In the embodiment shown, signage platform 16 includes two concave curved surfaces 34 at either end thereof which matingly engage with facia 26 of coping 14. That is, the curvature of concave curved surfaces 34 closely matches the curvature of facia 26. A plurality of additional interior concave curved surfaces 36 are spaced apart along the length of signage platform 16 on the rear side thereof between concave curved surfaces 34. Horizontal display wall 32 includes a plurality of through-holes 38 therein which are sized to receive a corresponding number of fasteners such as screws 40. Screws 40 pass through through-holes 38 and threadingly engage with corresponding holes (not shown) formed in the top of facia 26. Of course, a suitable adhesive may also be used.

Visual indicia 18 may be any type of suitable visual indicia suitable for a given application. In the embodiment shown, visual indicia 18 are in the form of letters defining a warning to swimmers using swimming pool 10. Visual indicia 18 may also be, e.g., in the form of graphics images. Visual indicia may be formed using stickers, paint, stencils, etc.

Figure 6:
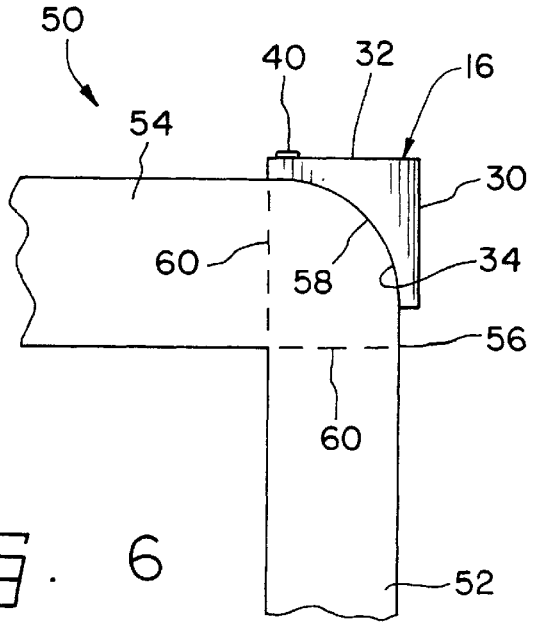
FIG. 6 is a fragmentary, side view of another swimming pool of the present invention including the signage platform shown in FIGS. 1–5.

FIG. 6 is a fragmentary, side view of another swimming pool 50 of the present invention including signage platform 16 shown in FIGS. 1–5. Swimming pool 50 includes a side wall 52 which adjoins with a deck 54. Side wall 52 includes a top 56 with a curved facia 58 to which signage platform 16 is attached using screws 40. Side wall 52, in the embodiment shown in FIG. 6, is in the form of a concrete or Gunite (TM) side wall. Thus, the primary difference between the embodiment of swimming pool 50 shown in FIG. 6 and the embodiment of swimming pool 10 shown in FIG. 1 is that swimming pool 50 does not include a coping for interconnecting side wall 52 with deck 54. Side wall 52 is shown as being unitarily formed with deck 54 (such as pouring side wall 52 and deck 54 simultaneously with concrete). However, it is to be appreciated that side wall 52 can be separately formed and attached to deck 54, such as indicated by dashed lines 60. Regardless of the particular construction method employed, signage platform 16 is defined herein to be connected to the top of side wall 52 at curved facia 58. Of course, the portion of the facia interconnecting side wall 52 with deck 54 to which signage platform 16 is attached need not be curved and/or need not be formed of concrete or metal, but rather may be formed from any suitable construction material such as tile, plastic or the like. Regardless of the construction method employed and the types of material used, the primary functionality of signage platform 16 is to provide display walls with visual indicia which may be easily viewed from a swimmer located on the side of pool 50 adjacent to signage platform 16 or the side of pool 50 opposite from signage platform 16.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A swimming pool, comprising:

at least one substantially vertical side wall having a top;

a coping attached to said top of said side wall, said coping having a curved facia;

a signage platform attached to said facia of said coping, said signage platform having a substantially vertical display wall and an adjoining substantially horizontal display wall; and visual indicia on each of said vertical display wall and said horizontal display wall.

2. The swimming pool of claim 1, wherein said curved facia of said coping comprises a convex curved facia, and wherein said signage platform includes at least one concave curved surface which matingly engages with said facia.

3. The swimming pool of claim 2, wherein said at least one concave curved surface comprises two concave curved surfaces.

4. The swimming pool of claim 1, further comprising a means for fastening said signage platform to said coping.

5. The swimming pool of claim 4, wherein at least one of said vertical display wall and said horizontal display wall includes a plurality of through-holes therein, and wherein said fastening means comprises a plurality of fasteners extending through said through-holes.

6. The swimming pool of claim 5, wherein said plurality of fasteners comprise a plurality of screws.

7. A coping assembly for use in a swimming pool having at least one substantially vertical side wall with a top, said coping assembly comprising:

a coping attached to said top of said side wall, said coping having a curved facia;

a signage platform attached to said facia of said coping, said signage platform having a substantially vertical display wall and an adjoining substantially horizontal display wall; and visual indicia on each of said vertical display wall and said horizontal wall.

8. A swimming pool, comprising:

at least one substantially vertical side wall having a top;

a signage platform connected to said top of said side wall, said signage platform having a first display wall and an adjoining second display wall, each of said first display wall and said second display wall being substantially flat surfaces;

visual indicia on each of said first display wall and said second display wall; said top of said side wall having a convex curved facia; and said signage platform including at least one concave curved surface which matingly engages with said facia.

* * * * *